US010375768B2

(12) United States Patent
Heise

(10) Patent No.: US 10,375,768 B2
(45) Date of Patent: Aug. 6, 2019

(54) APPARATUS AND ASSEMBLY FOR HEATING PIPES

(71) Applicant: Heat-Line Corporation, Carnarvon (CA)

(72) Inventor: Lorne R. Heise, Algonquin Highlands (CA)

(73) Assignee: Heat-Line Corporation, Algonquin Highlands (CA)

( * ) Notice: Subject to any disclaimer, the term of this patent is extended or adjusted under 35 U.S.C. 154(b) by 61 days.

(21) Appl. No.: 15/061,647

(22) Filed: Mar. 4, 2016

(65) Prior Publication Data

US 2016/0262211 A1 Sep. 8, 2016

Related U.S. Application Data

(60) Provisional application No. 62/128,847, filed on Mar. 5, 2015.

(51) Int. Cl.
*H05B 3/78* (2006.01)
*H05B 3/04* (2006.01)
*H05B 3/82* (2006.01)

(52) U.S. Cl.
CPC ..... *H05B 3/82* (2013.01); *H05B 3/04* (2013.01)

(58) Field of Classification Search
None
See application file for complete search history.

(56) References Cited

U.S. PATENT DOCUMENTS 2,933,708 A * 4/1960 Elliot ..... E21B 43/121 338/28
4,185,187 A * 1/1980 Rogers ..... F24H 1/102 219/496
4,423,311 A * 12/1983 Varney, Sr. ..... E03B 7/14 138/33
4,501,952 A * 2/1985 Lehrke ..... B05B 7/22 165/156
4,855,569 A * 8/1989 Wiedemann ..... F24H 1/0081 392/461
5,129,034 A * 7/1992 Sydenstricker ..... F24H 1/102 219/496
5,859,953 A * 1/1999 Nickless ..... E03B 7/14 138/33
5,872,890 A * 2/1999 LaCombe ..... F24H 1/102 392/487
5,892,887 A * 4/1999 Thomas ..... F24H 1/102 138/143
6,205,292 B1 * 3/2001 Pokorny ..... F24H 1/142 392/465
6,456,785 B1 * 9/2002 Evans ..... F24H 1/102 392/448
7,424,211 B2 * 9/2008 Lehmann ..... F01M 5/001 392/314

(Continued)

*Primary Examiner* — Thor S Campbell
(74) *Attorney, Agent, or Firm* — Blake, Cassels & Graydon LLP; John R.S. Orange; Brett J. Slaney

(57) ABSTRACT

A heater is provided for a waste water system comprising of a heating element encased in a protective pipe. The pipe is closed at one end and attached at the opposite end to an end cap that may be connected by a standard fitting to a sewer installation. The protective pipe is sealed to the end cap and the heating element is removable from within the protective pipe without adversely affecting the integrity of the installation.

20 Claims, 22 Drawing Sheets

(56) References Cited

U.S. PATENT DOCUMENTS

| | | | | |
|---|---|---|---|---|
| 8,028,721 | B2 * | 10/2011 | Koskey, Jr. | F16L 53/008 138/32 |
| 8,238,733 | B2 * | 8/2012 | Sawada | F16L 53/008 138/33 |
| 9,206,934 | B2 * | 12/2015 | Reusche | F16L 53/008 |
| 9,568,137 | B2 * | 2/2017 | Heise | F16L 53/008 |
| 9,624,806 | B2 * | 4/2017 | Mann | F01N 3/208 |
| 9,664,086 | B2 * | 5/2017 | Birman | F01N 3/2066 |
| 2004/0131346 | A1 * | 7/2004 | Chamberlain, Jr. | F24D 17/00 392/490 |
| 2008/0317450 | A1 * | 12/2008 | Sawada | F16L 25/01 392/485 |
| 2009/0266435 | A1 * | 10/2009 | Ferrone | A01K 7/027 138/33 |

* cited by examiner

APPARATUS AND ASSEMBLY FOR HEATING PIPES

CROSS-REFERENCE TO RELATED APPLICATIONS

This application claims priority to U.S. Provisional Patent Application No. 62/128,847 filed on Mar. 5, 2015 and the entire contents of which is incorporated herein by reference.

TECHNICAL FIELD

The following relates generally to an apparatus and assembly for heating fluids within a pipe.

BACKGROUND OF THE INVENTION

In cold weather conditions, it is known that the fluid within pipes, such as water mains, drain lines, storm drains and sewers, which does not flow continuously is likely to freeze, thereby causing a blockage of the pipe. One solution is to chemically change the properties of the fluid flowing through the pipe so as to reduce its tendency to freeze in cold conditions. However, this can have an adverse effect on the liquid being transported and it is not usually feasible or economical.

Another solution is to heat the contents within the pipe so as to counteract the external environmental conditions. Such a solution can include using heat blankets positioned on the outside of the pipe. This is only possible when the pipe is easily accessible. Another option is to use specialty pipes with heated wires permanently located or fixed on the interior or exterior surface of the pipes to increase the temperature of the fluid so as to prevent freezing. This may also not be feasible for existing pipes as it would require replacing the pipes altogether and would be costly for most consumers. Furthermore, as it is difficult to remove the wire from the pipe or to access the wire within the pipe, repair or maintenance of the wire located within the pipe is problematic. Where the wire is located adjacent the surface of the pipe, it may also be vulnerable to normal procedures used for cleaning the pipe in which the wire is installed as threading a cleaning tool through a pipe can often damage the wire rendering it inoperable.

In another option, customers may seek to heat the pipe locally from the exterior (e.g. by applying a heat source) but localised heating may cause damage to the pipe as the ice thaws.

In general, many current waste water systems are prone to freezing during winter and require a method to provide a reliable pipe freeze protection. The only current CSA approved solution is to install a heating cable on the outside of the pipe. However, such cables may make only point contact with the outside of the pipe and may cause localised damage to the pipe or may cause localised boiling of liquid in the pipe. As a result, thermal insulation of the pipe is avoided, leading to high energy consumption for the cable.

It has been proposed to insert a heating cable within a pipe and control the current to the heating cable to prevent freezing. This has proven to be a viable solution in the supply of water to residential units where burial of the supply line is impractical. The cable is surrounded by the water which dissipates heat within the pipe and avoids localised overheating. As such, the exterior of the pipe may be insulated without risking damage to the pipe itself.

Whilst the above arrangement is satisfactory for water supply, and has CSA approval, it cannot be used in an environment such as sewer lines and septic fields where explosive or inflammable gas may be present, or under conditions where high pressures may be encountered, such as a high pressure water main.

Therefore, it is an object of the present invention to obviate or to mitigate at least some of the above presented disadvantages.

SUMMARY

In its broad aspect, the present invention provides a heater assembly for a water system consisting of a heating element encased in a protective pipe. The protective pipe is closed at one end and has a retainer adjacent the opposite end that may be connected by a standard fitting of a water line. The protective pipe is sealed to the retainer and the heating element passes through a bore in the retainer so as to be removable from within the protective pipe without adversely affecting the integrity of the installation.

Preferably, the retainer is a cap removably mounted in the standard fitting to facilitate removal of the heater assembly for routine maintenance of the waste water system.

Preferably, the heating element is connected to a power supply adjacent to the opposite end of the protective pipe and the connection protected by a seal assembly.

In a preferred embodiment, the seal assembly includes a heat shrinkable sleeve to cover the connection of the power supply to the heating element and a sleeve to extend over the protective pipe.

BRIEF DESCRIPTION OF THE DRAWINGS

Embodiments of the invention will now be described by way of example only with reference to the accompanying drawings in which.

DETAILED DESCRIPTION

The following is a detailed description of the preferred embodiments. The description should not be considered as limiting the scope of the assembly or apparatus contained herein.

Figure 1:
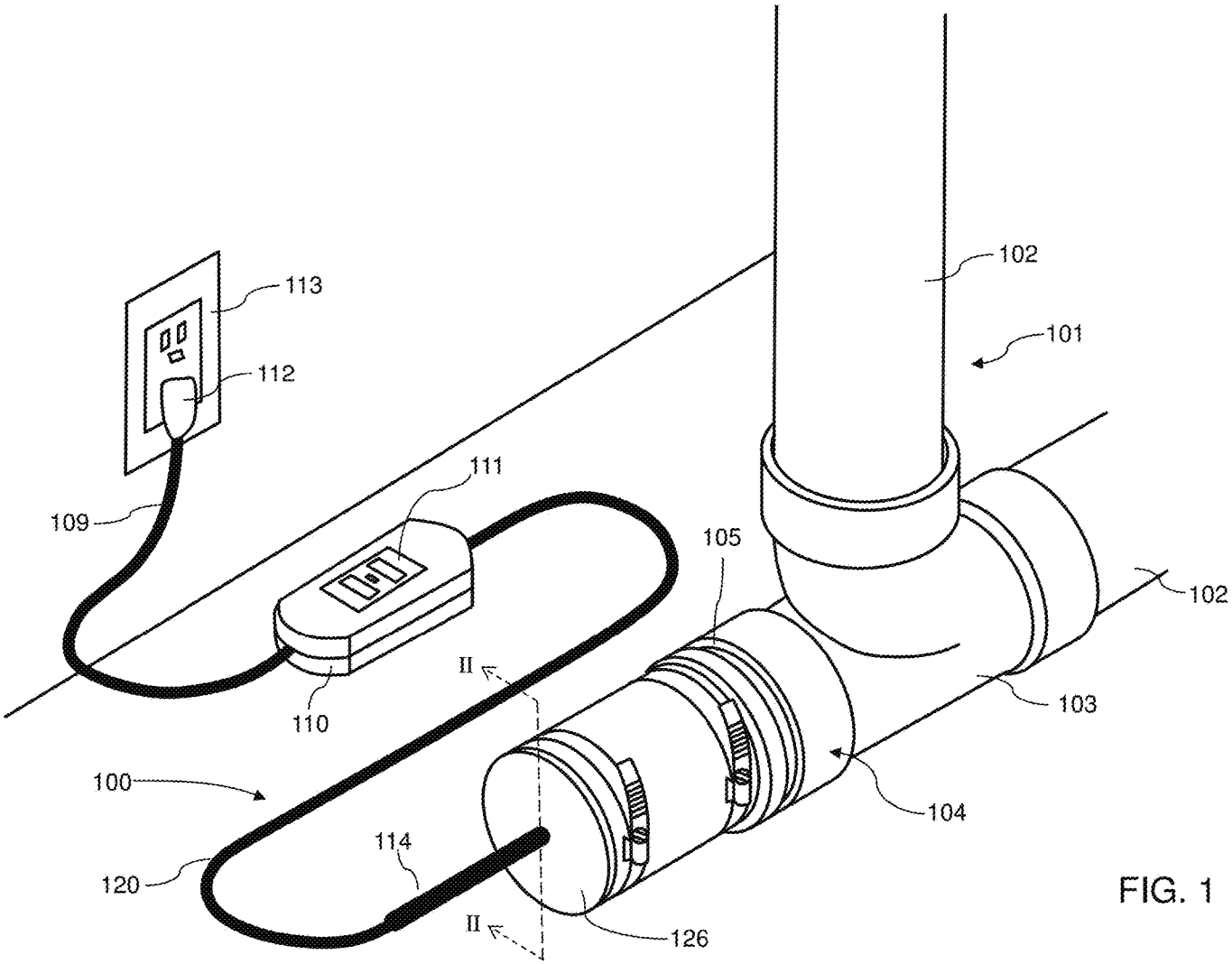
FIG. 1 illustrates a heating assembly as installed in a cleanout plug of a sewer or waste drain pipe.
Figure 4:
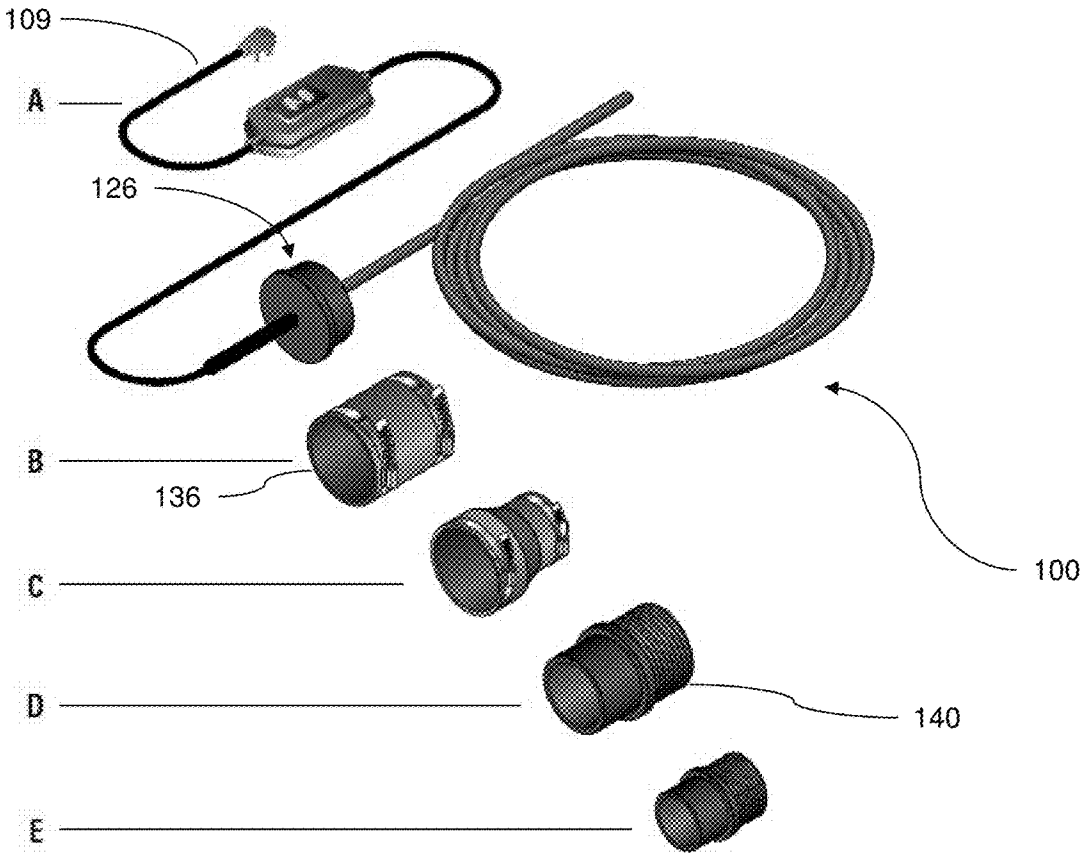
FIG. 4 is an exploded view of the components of the heating assembly of FIG. 1.
Figure 13:
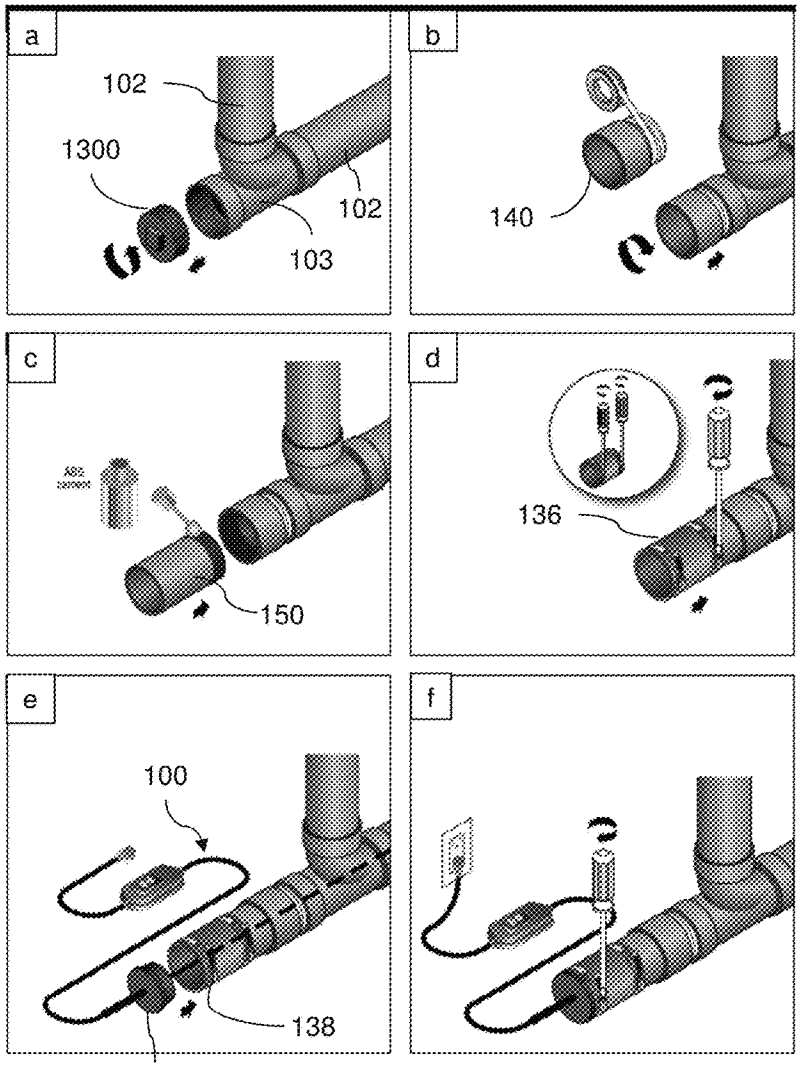
FIG. 13 illustrates schematically the installation of the heating assembly of FIG. 1 in a waste water system.

Referring to FIGS. 1 and 4, a heating assembly 100 is installed on a typical residential or commercial waste water system 101. The waste water system 101 includes a pair of sewage pipes 102 connected by a Y-elbow 103. The Y-elbow 103 includes a clean out port 104 extending from one leg of the Y-elbow. The port 104 has an internally threaded collar 105 that is provided to receive a fitting, typically an externally threaded plug 1300 as shown in FIG. 13. The port 104 is used to connect the heating assembly 100 to the waste water system 101, as is described below.

Figure 7:
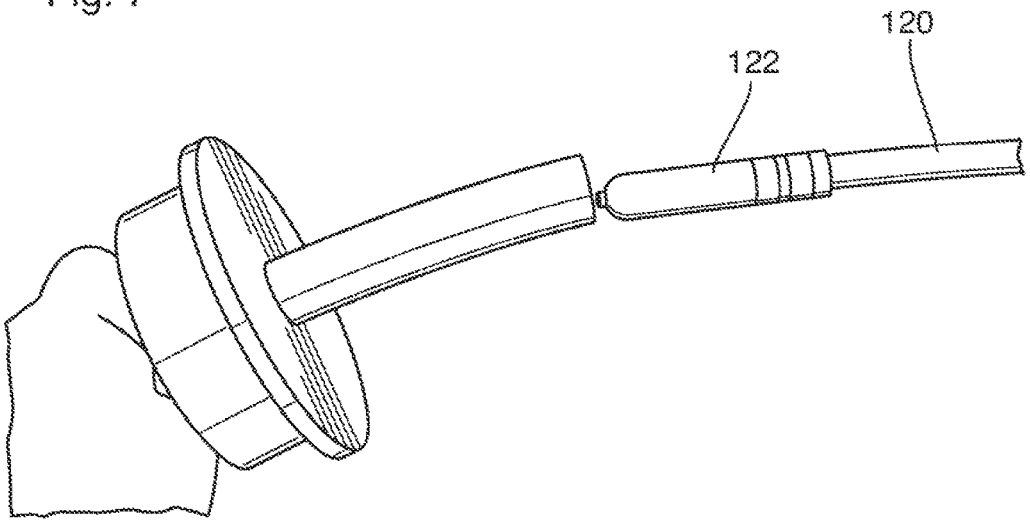
FIG. 7 shows the components of FIG. 4 during initial assembly.
Figure 8:
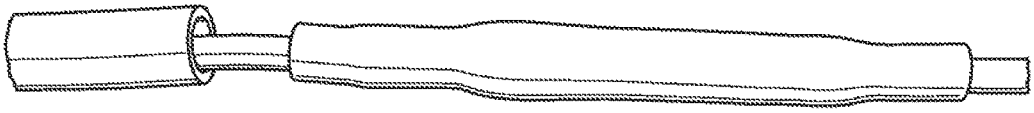
FIG. 8-11 show the components of FIG. 4 during final assembly and sealing of the heating element in the heating assembly.
Figure 9:
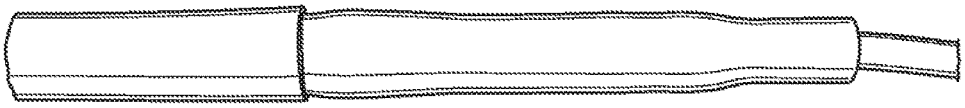
Figure 10:
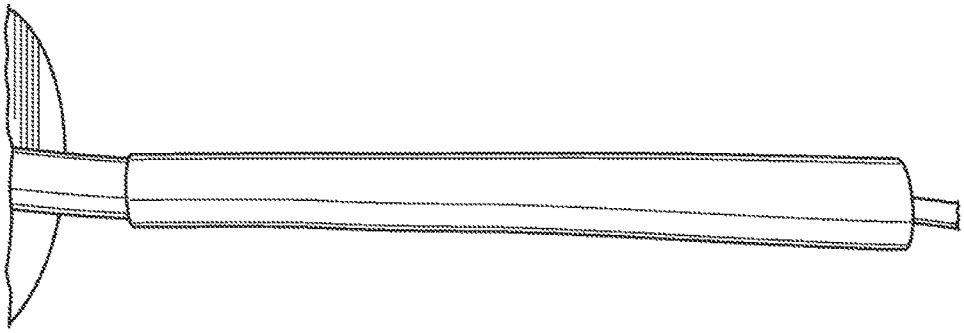
Figure 11:
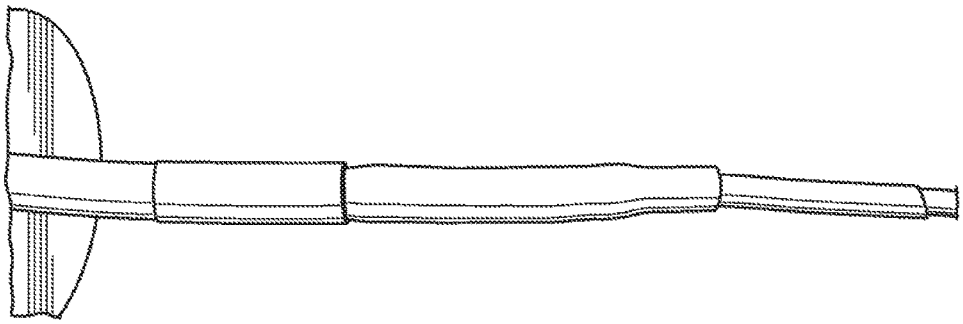
Figure 12:
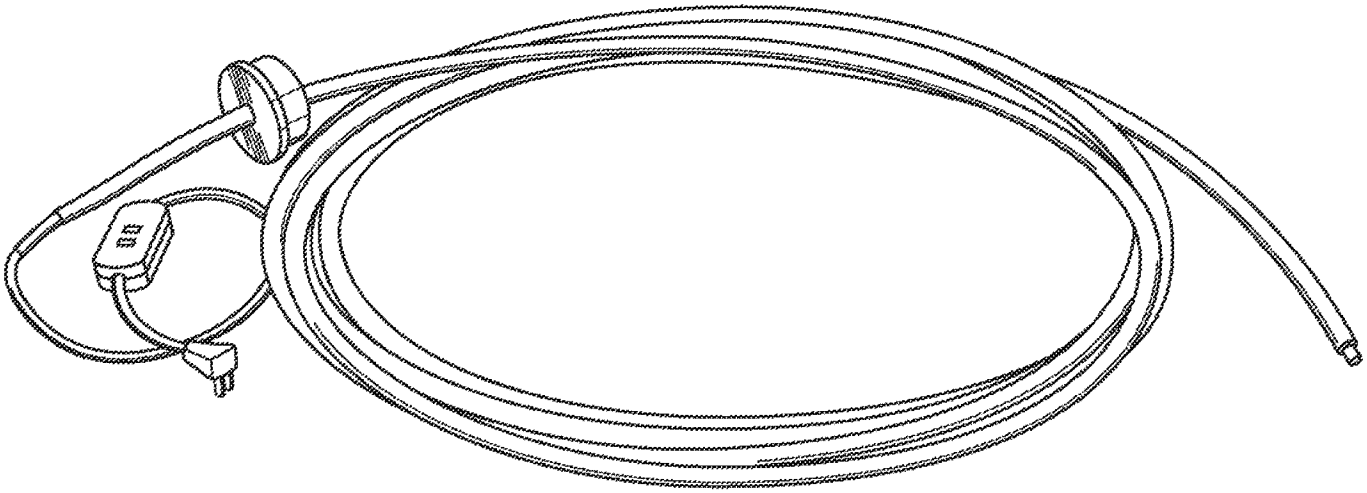
FIG. 12 illustrates assembled components of the heating assembly of FIG. 1, after assembly

The heating assembly 100 includes an electrical cord 109, fitted with a plug 112 for connection to a power supply 113, through a Test/Reset GFCI (111) located in a controller (110). The cord 109 is electrically connected to a heating element 120 (FIG. 2) which is preferably a self-regulating heating cable, such as that available from Heat-Line of Canaervon, Ontario, under the trade name HTLN-ATI-5-120R and HTLN-ATI-5-240R. The connection between the cord 109 and heating element 120 is covered with a seal assembly 114 to protect the connection, as will be described in more detail below. The distal end of the heating element 120 is sealed and capped with a protective boot 122 (FIG. 7) about 60 mm in length and a diameter that tapers from 14 mm to 12 mm.

Figure 2:
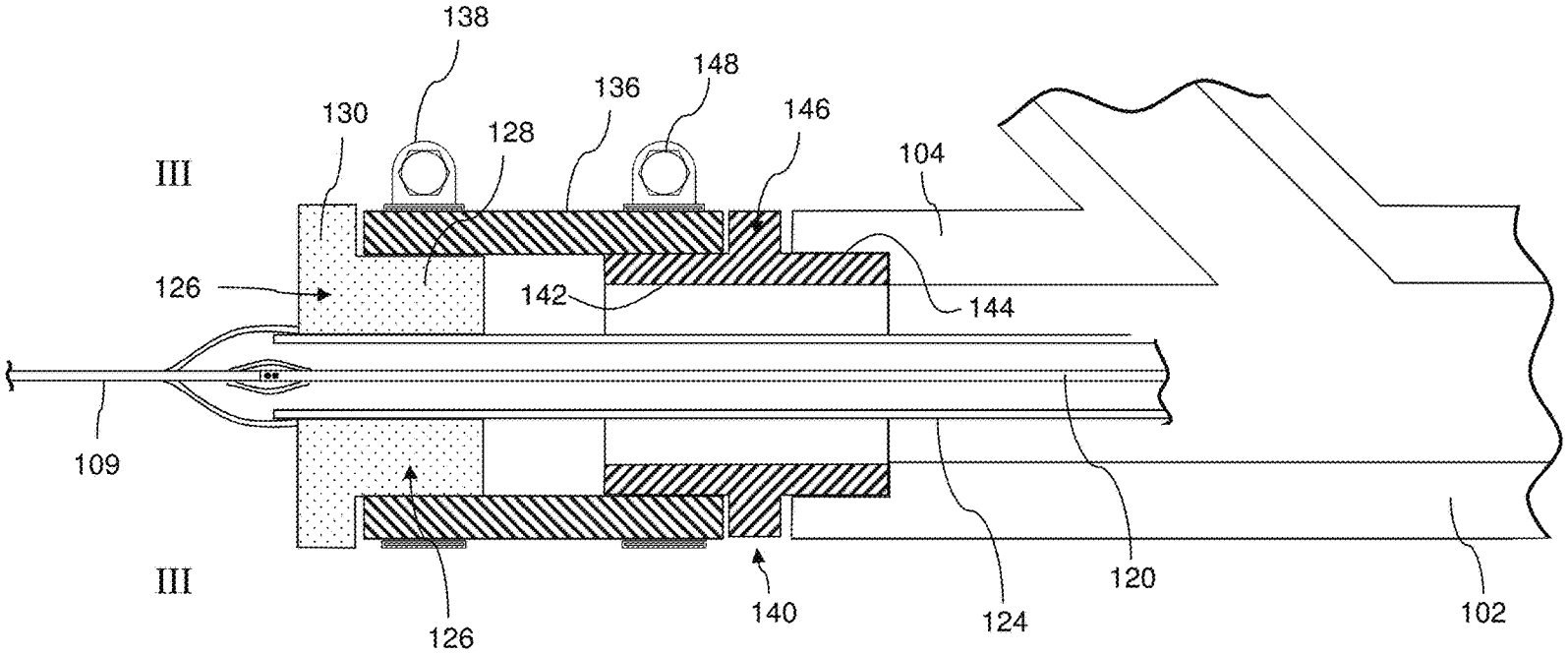
FIG. 2 is a section on the line II-II of FIG. 1.

As seen in FIG. 2, the heating element 120 is located within a protective pipe 124 with an internal diameter to accommodate the heating element 120 without undue clearance. The pipe 124 is flexible with sufficient stiffness to allow it to be pushed along the interior of the pipes 102 without buckling. A commercially available HDPE pipe has been found suitable, or alternatively pipe made from ABS, PVC, PEX, or similar materials. In one example a HTLN-ATI-5-120R heating cable from Heat-Line with a cross sectional dimension of 11 mm×6 mm was used in combination with a ½ inch or 12.7 mm ID HDPE (high density polyethylene) pipe. This provided sufficient clearance to allow the heating element to be inserted, but a close enough fit to avoid buckling during the insertion. The protective pipe 124 had sufficient flexibility to accommodate bends in the sewer pipe 102 but sufficient rigidity to allow the pipe 124 to be pushed along the interior of the sewage pipe 102. The protective pipe 124 may be of any convenient length to suit the particular application, and may extend 200 or 300 feet along the water system when required.

The heating assembly 100 also includes a retainer configured as a plug 126 which has a boss 128 and a flange 130. The pipe 124 passes through a bore 125 in the plug 126 with a tight sliding fit to facilitate a seal between the protective pipe and the plug 126. The diameter of the boss 128 is chosen to correspond with a male connector of a standardized plumbing fitting, nominally a 4 inch diameter male fitting, for conveniently incorporating into an existing system with standard components. The boss 128 is cylindrical to allow a push fit into a plumbing fitting secured to the port 104.

Figure 5:
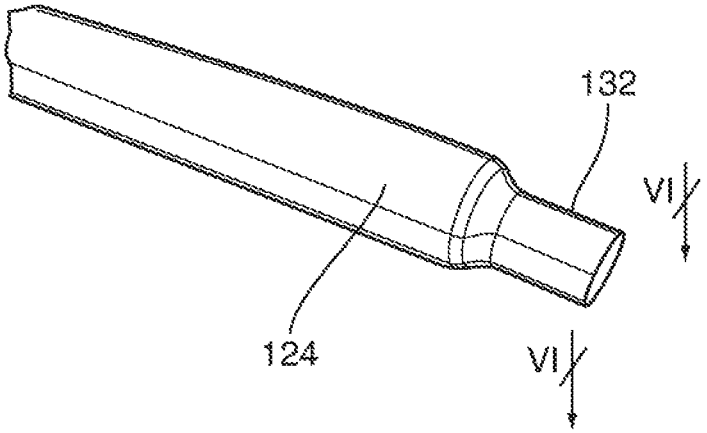
FIG. 5 is an enlarged view of a distal end of a component shown in FIG. 4.
Figure 6:
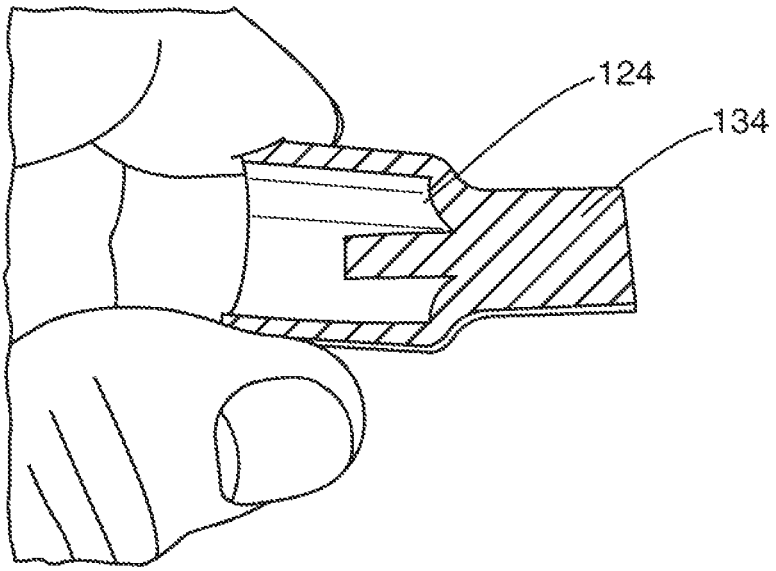
FIG. 6 is a cross section on the line VI-VI of FIG. 5.

The distal end 132 (FIGS. 5 and 6) of the protective pipe 124 is sealed with an end plug 134 which is fusion welded to the wall of the protective pipe 124 for a permanent gas tight seal. The distal end 132 may be tapered or otherwise reduced in diameter, as shown in FIGS. 5 and 6 to assist in inserting the protective pipe in to the sewer pipe.

Figure 3:
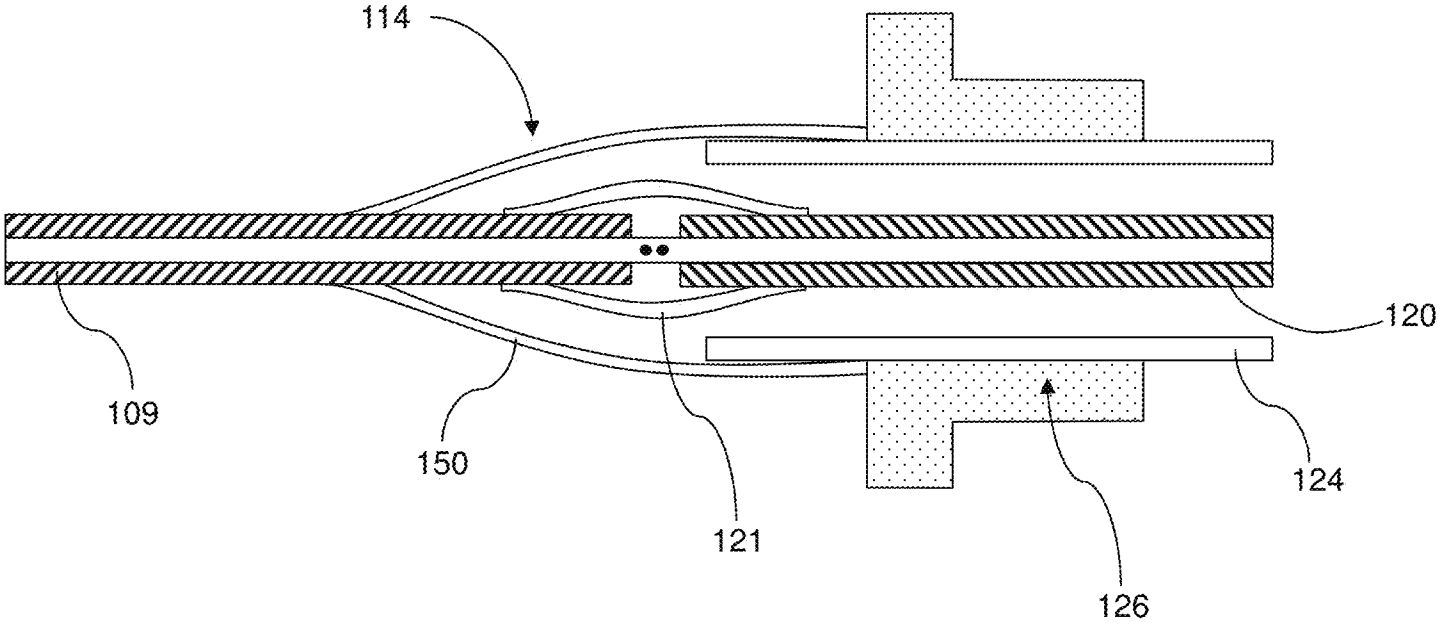
FIG. 3 is an enlarged view of the section shown in FIG. 2.

As can best be seen in FIG. 2, the heating element 120 is inserted in to the protective pipe 124 so that when assembled, the heating element 120 extends within the protective pipe 124 along a substantial extent of the pipe. The connection of the cable 109 to the heating element 120 is positioned at the outer end of the protective pipe 124, outboard of the plug 126. The seal assembly 114, better seen in FIG. 3 includes a heat shrinkable sleeve 121 that encompasses the cable 109 and heating element 120 and butts up to the end of the protective pipe 124. The seal assembly 114 also includes an outer flexible sleeve 150 that is positioned over the end of the pipe 124 and cable 109 to seal the cable 109 to the pipe 124.

The plug 126 is connected to the waste water system 101 through a coupling 136. The coupling 136 is a flexible coupling, such as that available from Fernco, that is compatible with waste water treatment systems. The coupling 136 is dimensioned to receive the male boss 128 as a push fit and a worm screw clamp 138 secures the coupling 136 to the boss. The compression force applied by the worm screw clamp 138 establishes a gas tight seal between the plug 126 and coupling 136 and is also found to be sufficient to establish a gas tight seal between the plug 126 and the protective pipe 124 in the bore 125. The plug 126 thus acts as a retainer to secure the heating assembly to the waste water system 101.

The opposite end of the coupling 136 is connected to a threaded male fitting 140 which has a plain cylindrical boss 142 at one end and a screw thread 144 corresponding to the screw thread in the clean out port 104 at the other. A flange 146 separates the screw thread 144 from the boss 142 and a screw clamp 148 secures the coupling 136 on to the boss 142 of the fitting against the flange 146. The thread 144 is threaded in to the clean out port 104.

As illustrated in FIG. 13, to install the heating assembly 100, the threaded cleanout plug 1300 is removed first from the waste water system 104. Such ports are required by plumbing codes and are placed at frequent intervals along the length of the system, usually at a bend in the system, to facilitate maintenance. A male fitting 140 is then threaded in to the clean out port 104 with the threads covered with a low friction Teflon tape to ensure a tight seal. A male boss 142 is provided at the opposite end to the threads.

If necessary, where spacing of the end cap from the Y-elbow 103 is required, the connection to the clean out port 104 may be made with a female threaded coupling, as illustrated in 13(*b*), and a length of pipe 150 cemented to the female coupling as shown in FIG. 13(*c*) to provide the male boss 142.

The coupling 136 is located on the male boss 142, provided by either the fitting 140 or pipe 150 in the alternative configuration, and secured with the screw clamp 148. The heating assembly 100 is then inserted in to the waste water system through the port 104. The plug 126 is then connected to the coupling 136 by feeding the protective pipe 124 containing the heating element through the coupling and in to the sewer pipe 104. The protective pipe is inserted until the boss 128 is located within the coupling 136 with the flange 130 abutting the coupling 136. The screw clamp 138 then secures the plug 126 to the coupling 136 in a fluid tight seal and also seals the protective pipe 124 to the plug 126. It will be noted that the push fitting between the boss 128 and the coupling 136 enables the heating assembly to be inserted without rotation relative to the port 104, and the sliding fit of the protective pipe 124 within the bore 125 enables the position of the plug to be adjusted on the protective pipe 124 during assembly. If required by the particular application, an additional seal, such as a caulk or cement may be provided at the outer end of bore 125.

With the protective pipe 124 located within the system 101, heat may be selectively applied from the power supply to maintain the contents of the sewer pipe above freezing. The protective pipe 124 protects the heating element from external damage, but is sufficiently closely spaced to the heating element to transfer the heat from the element to the interior of the sewer pipe. The protective pipe 124 has sufficient flexibility to follow deviations of the sewer pipe and so may extend a significant distance along the sewer pipe.

The protective pipe 124 encapsulates the heating element 120 and provides a gas and water impermeable enclosure. This ensures that the heating element 120 is not in contact with the potentially flammable sewer gas, and therefore complies with established safety measures. Similarly, the connection of the end cap 126 to the clean out port 104 using conventional fittings ensures that the integrity of the system 101 is maintained.

Should it be necessary to remove the heating element 120 for inspection, it is possible to either remove the entire heating assembly 100 and disassemble the heating element, or to simply remove the sleeve 150 and extract the heating element 120 from within the protective pipe 124. The protective pipe 124 is then left in situ and the integrity of the system 101 maintained whilst the heating element 120 is inspected.

Figure 14:
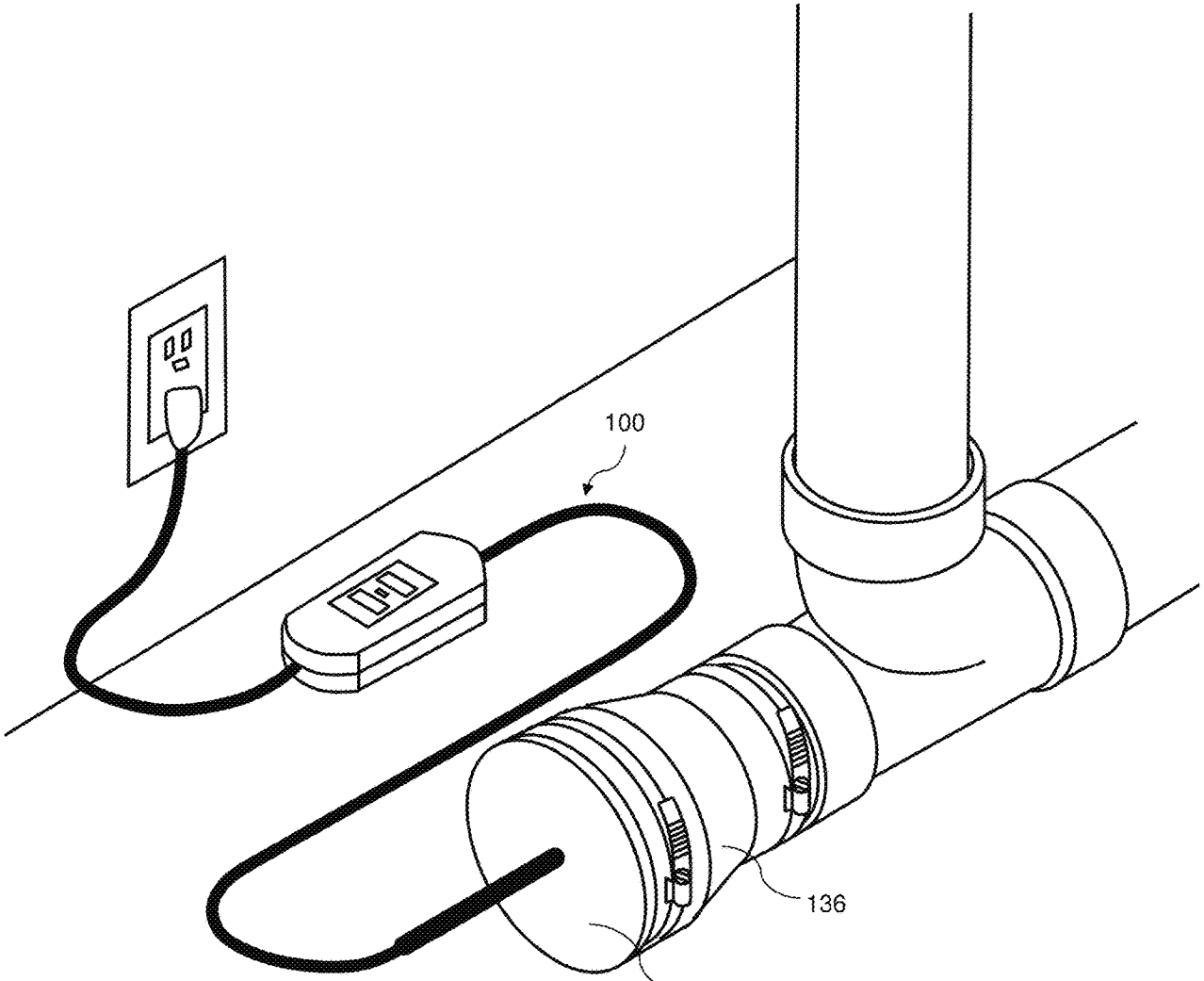
FIG. 14 illustrates a heating assembly as installed for use in an alternative embodiment of waste water system.
Figure 15:
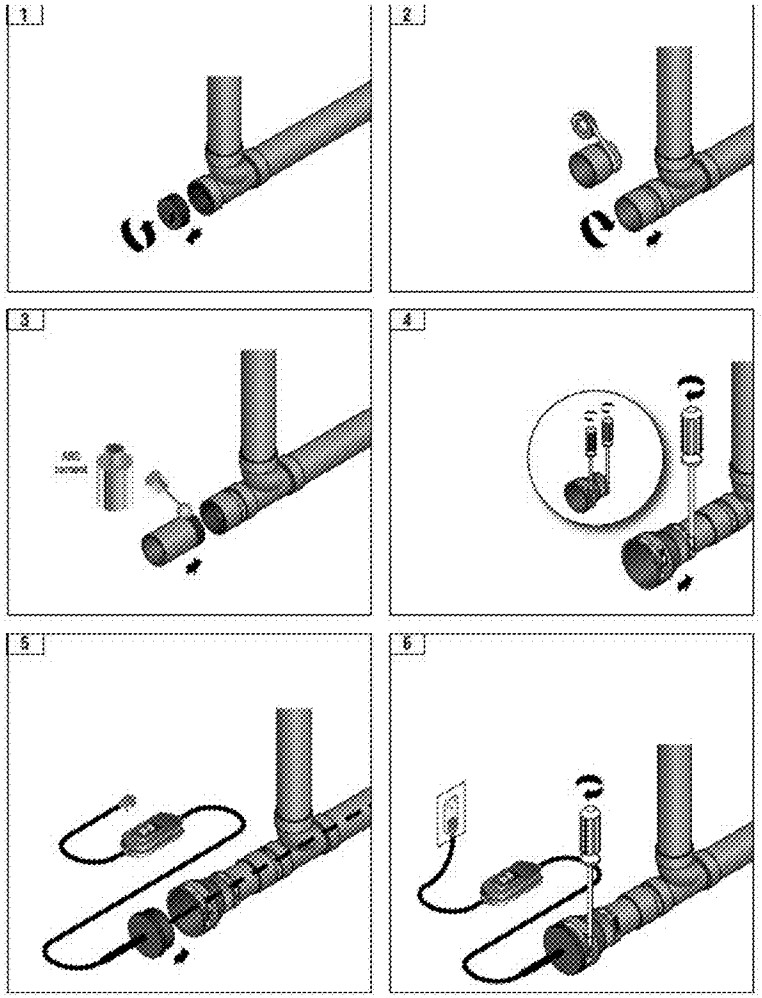
FIG. 15 illustrates schematically the installation of the heating assembly of FIG. 14.

In the above arrangement, the clean out port 104 is the same nominal diameter as the plug 126. In some installations, the sewer pipes may be of a different diameter and an alternative configuration of fitting is used. As can be seen in FIGS. 14 and 15, where the sewer pipes 104 have a smaller diameter than the plug 126, a flared coupling 136 is used having the different diameters at opposite ends. Again, as with the embodiment of FIG. 13, the male boss 142 may be provided directly on the fitting 140 or may be provided by an extension pipe 150.

Figure 16:
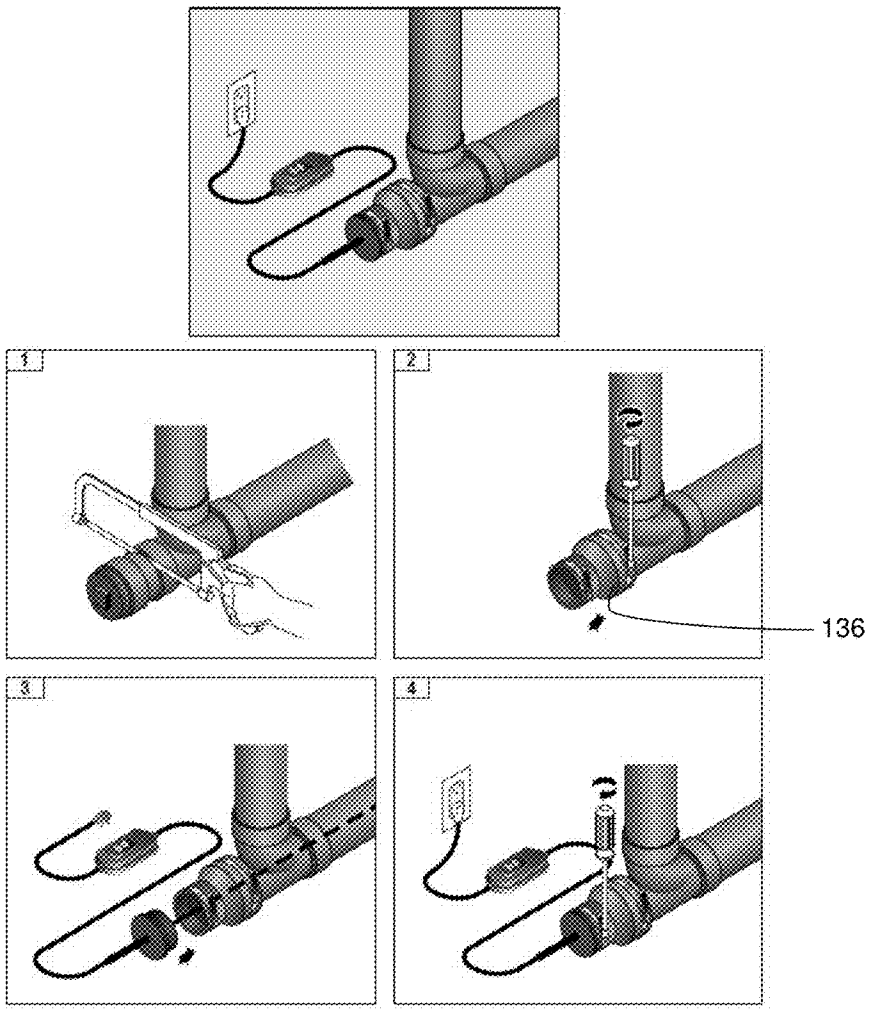
FIG. 16 illustrates schematically an alternative installation procedure for the heating assembly of FIG. 1.

Similarly, as shown in FIG. 16, where the sewer is larger than the plug 126, the flared coupling 136 is reversed to accommodate the different sizes. As can also be seen in FIG. 16, the existing system may be modified by removal of the clean out port 104 and connecting the large end of the flared bushing over the end of the remaining pipe.

Figure 17:
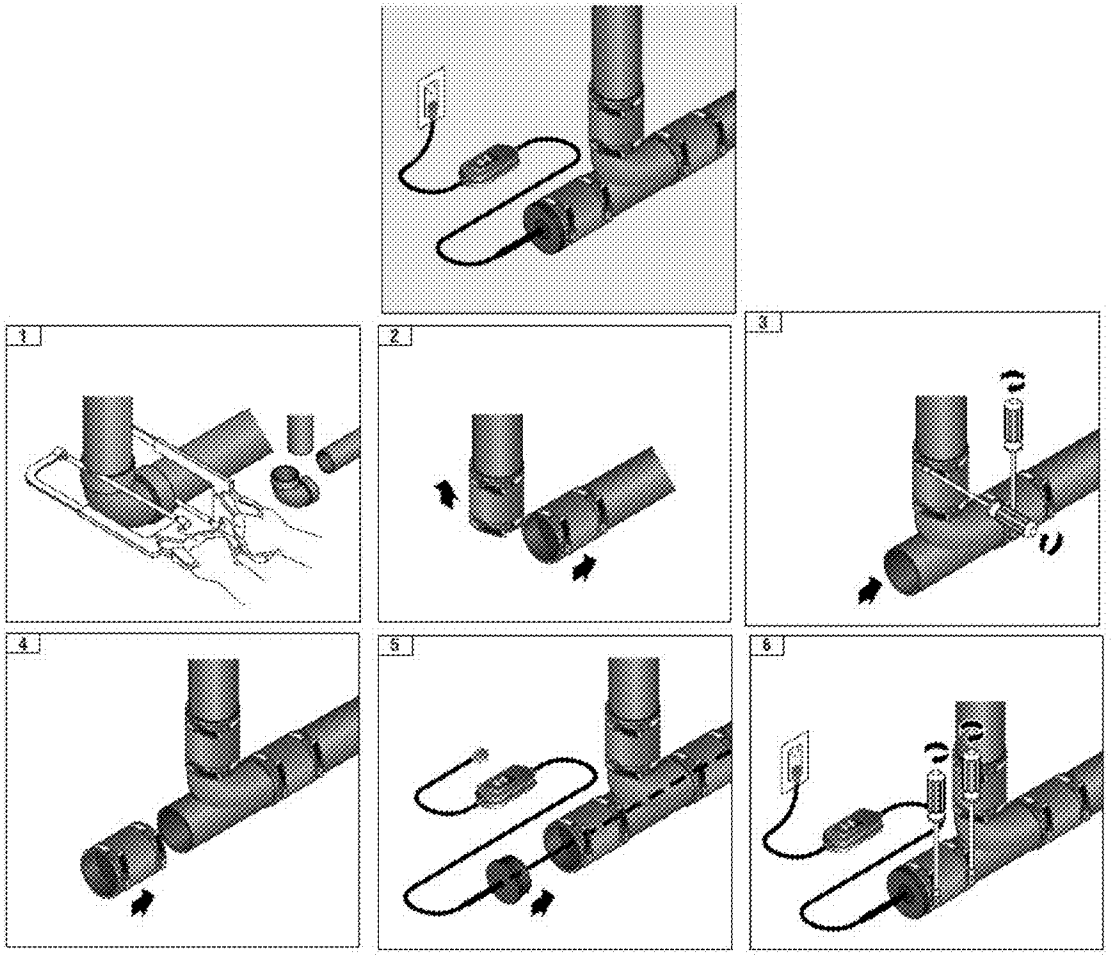
FIG. 17 illustrates schematically a further installation procedure for the heating assembly of FIG. 1.

The above description assumes that a Y-elbow with a clean out port is available to facilitate connection of the heating assembly 100. Where such a port is not available, the waste water system 101 may be readily adapted to permit such use using standard fittings. As shown in FIG. 17, a 90° elbow may be removed and replaced with a Y-elbow using the flexible couplers. This permits an installation as shown with respect to FIG. 1.

Figure 18:
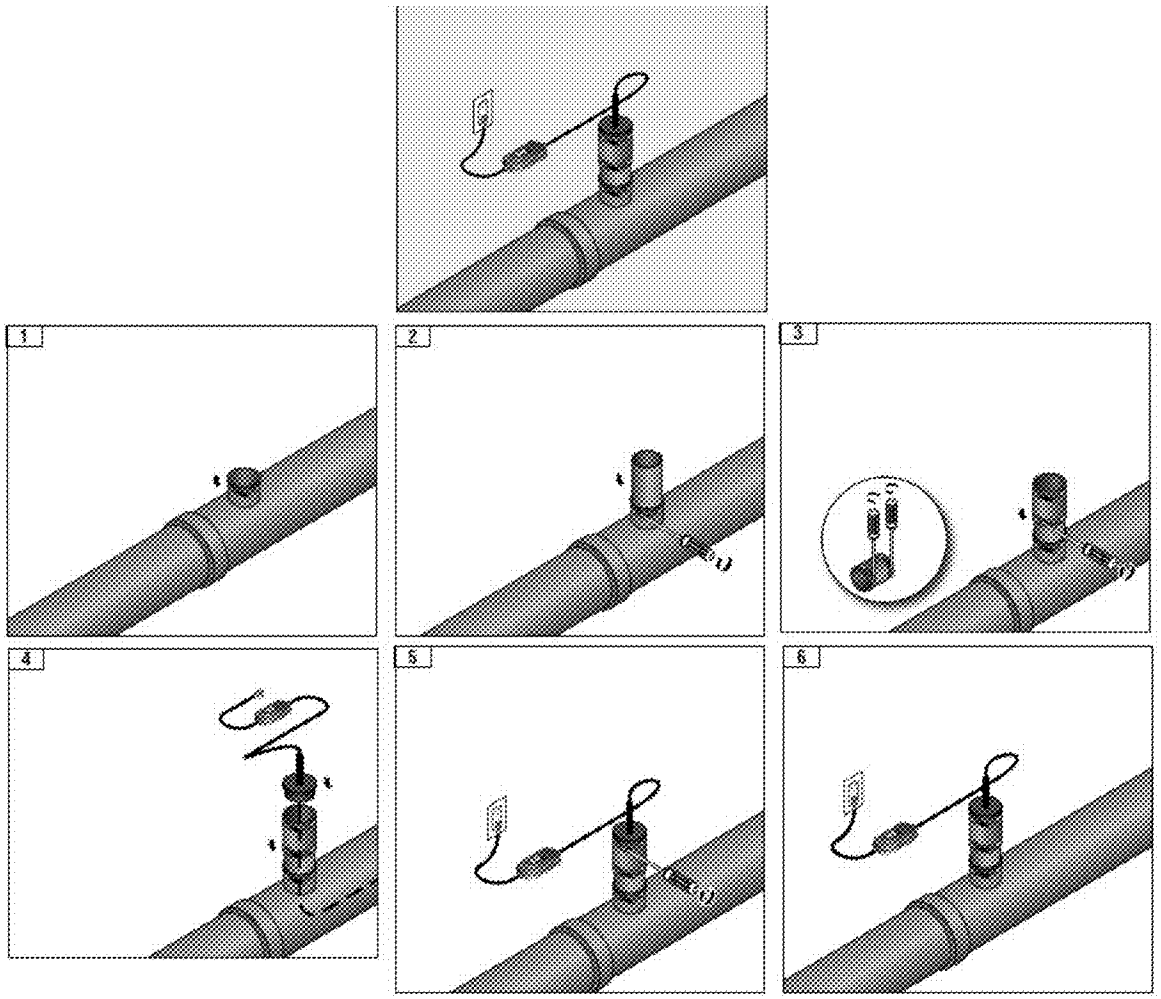
FIG. 18 illustrates schematically installation for the heating assembly of FIG. 1 on a large diameter pipe.

In another situation, as shown in FIG. 18, a Tee is used to connect a short length of pipe with flexible couplings so the protective pipe may be installed. It will be noted that the protective pipe has sufficient flexibility to be inserted in to the pipe 104 and flex through a 90 degree bend to run along the length of the sewer pipe.

Figure 19:
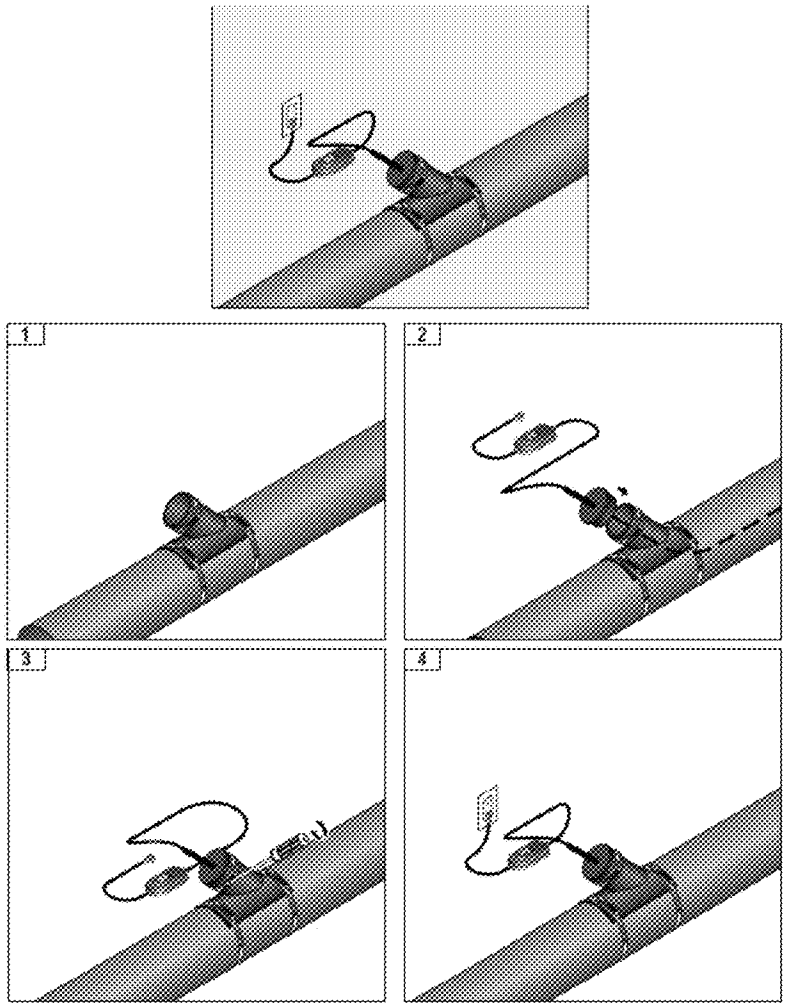
FIG. 19 illustrates an installation procedure using a saddle for the heating assembly of FIG. 1.

A similar arrangement is possible, as shown in FIG. 19, using a 45° saddle connection after a hole is cut in to the sewer pipe 104. Again the flexibility of the protective pipe allows the pipe and heating element to be inserted at an angle and project along the sewer pipe.

Figure 20:
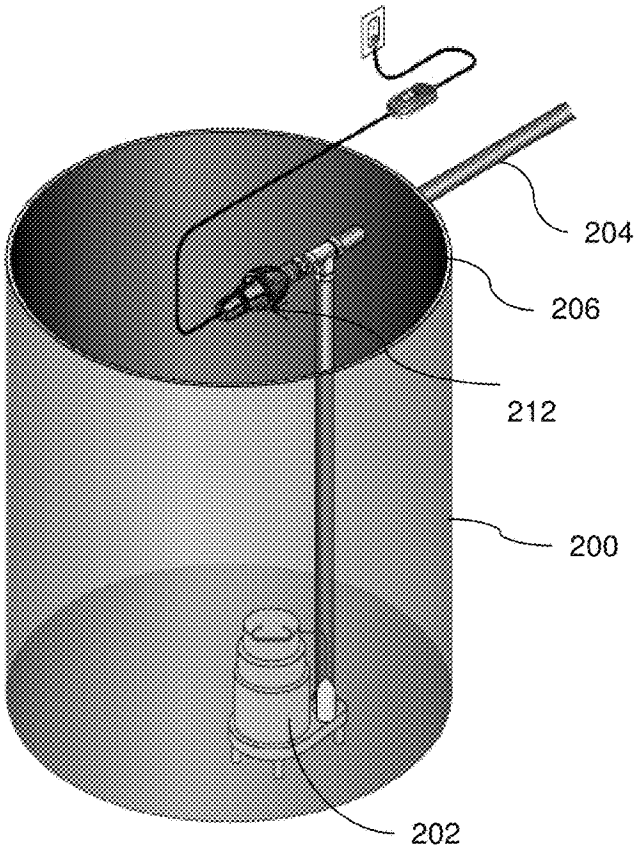
FIG. 20 illustrates a heating assembly as installed in a sewage basin for use in a pressurized sewage and grey water forced mains in accordance with an alternative embodiment.
Figure 21:
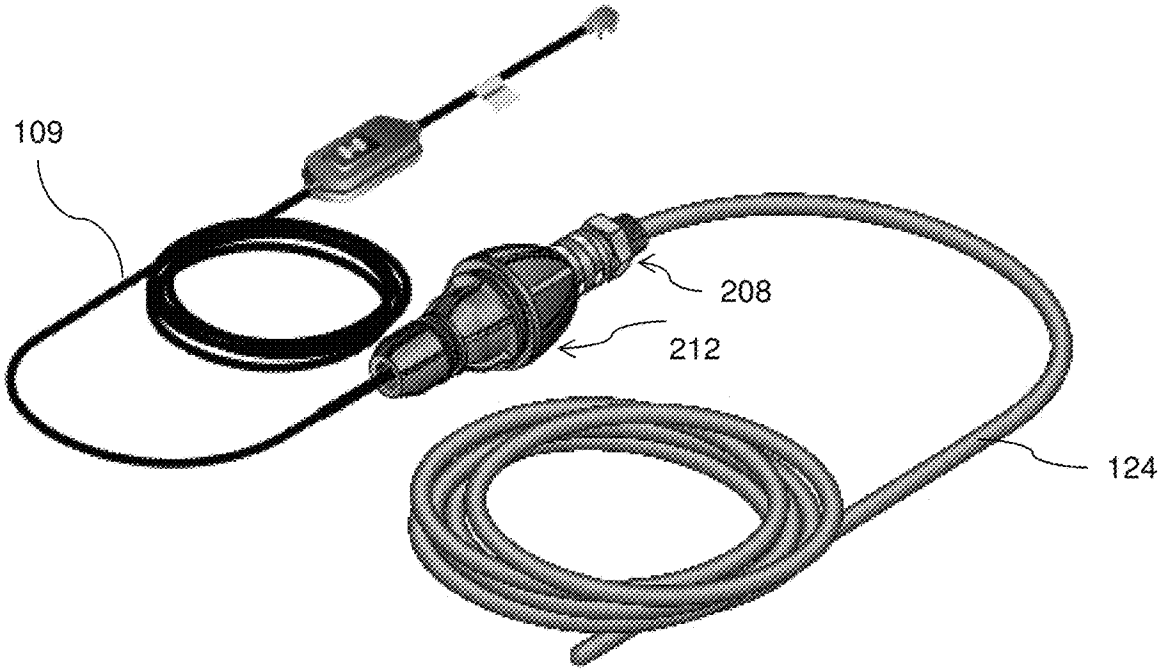
FIG. 21 illustrates the assembled heating assembly of FIG. 20 shown in isolation.
Figure 22:
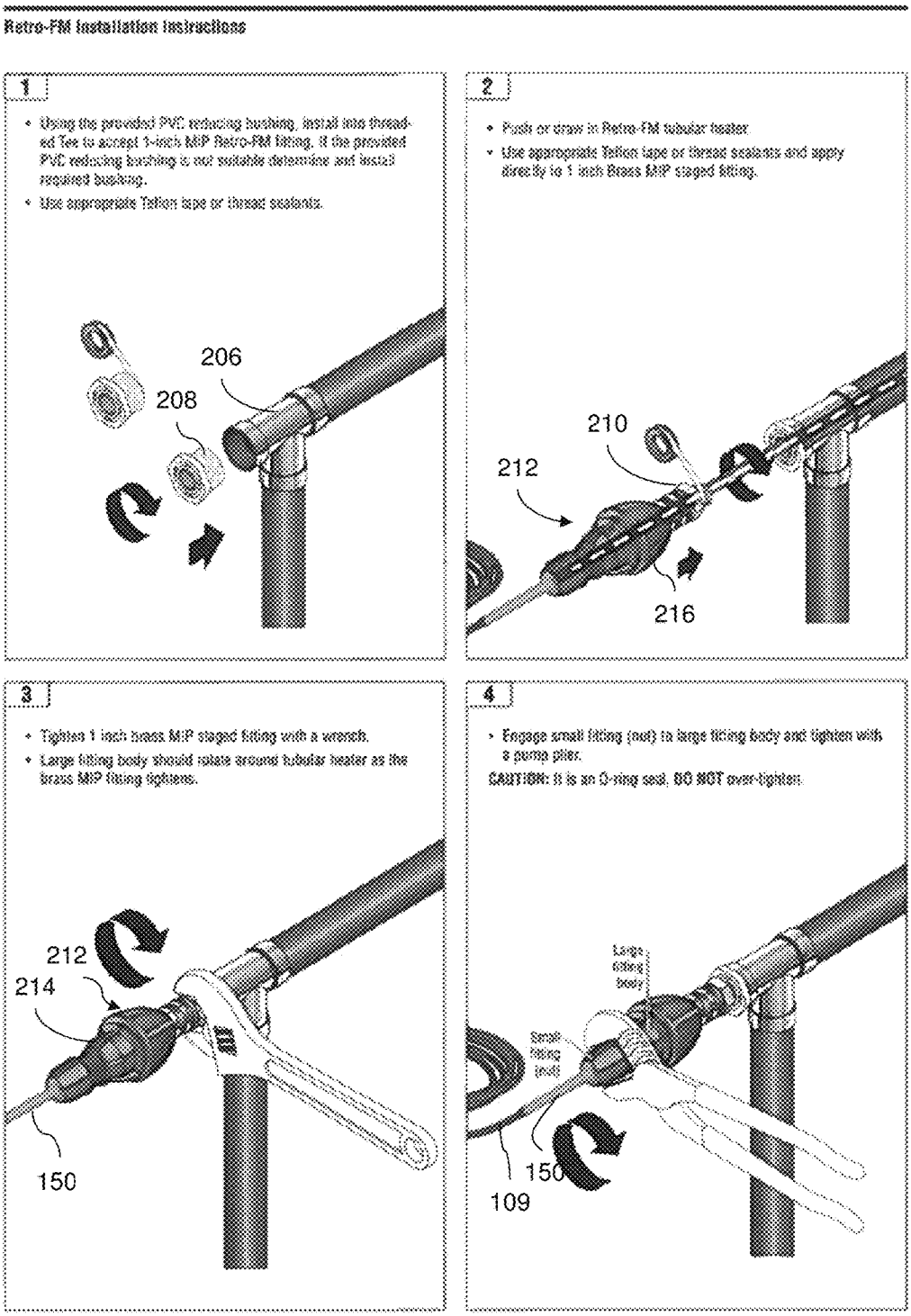
FIG. 22 illustrates an installation procedure for assembling the internal components of the heating assembly of FIG. 20 for installation on a sewage basin.
Figure 23:
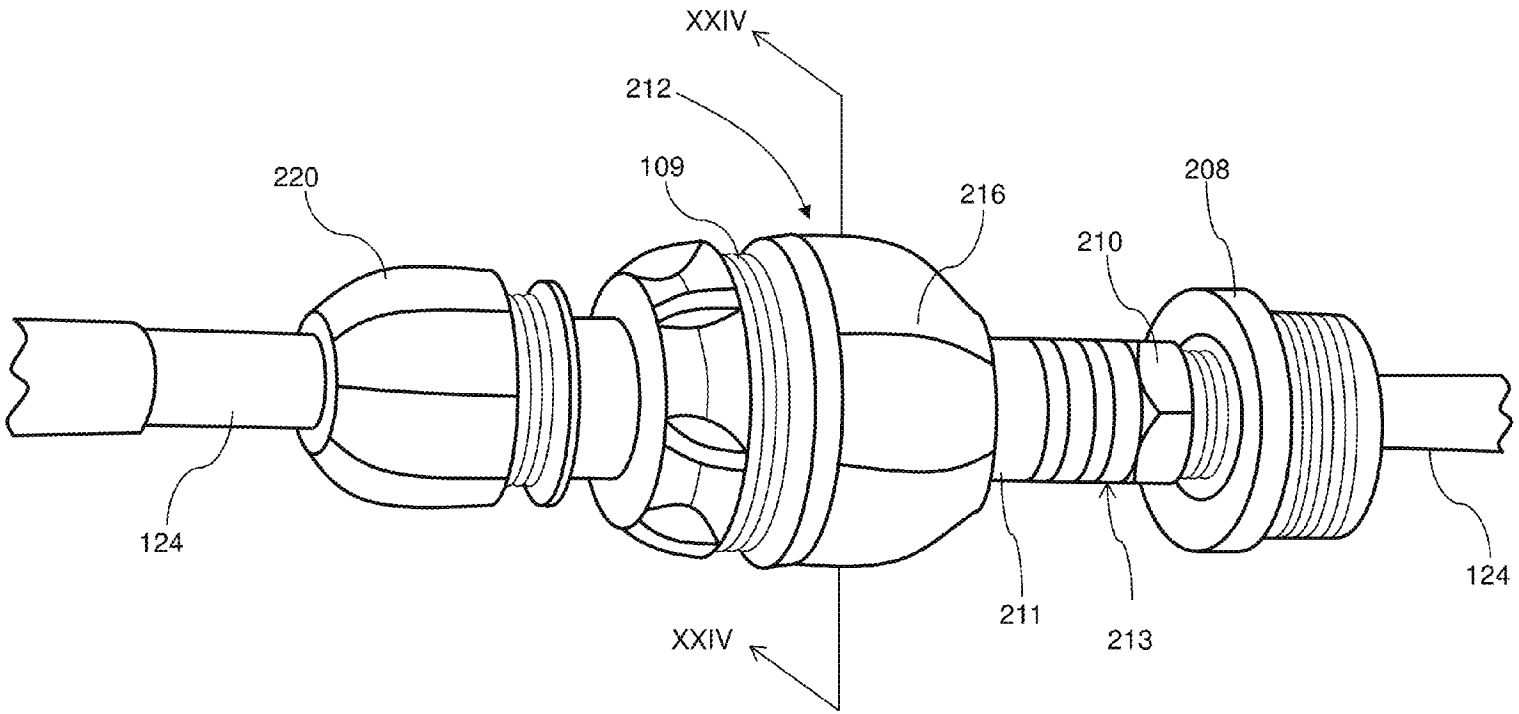
FIG. 23 illustrates a schematic view of the components of a coupling assembly for the heating assembly of FIG. 20.
Figure 24:
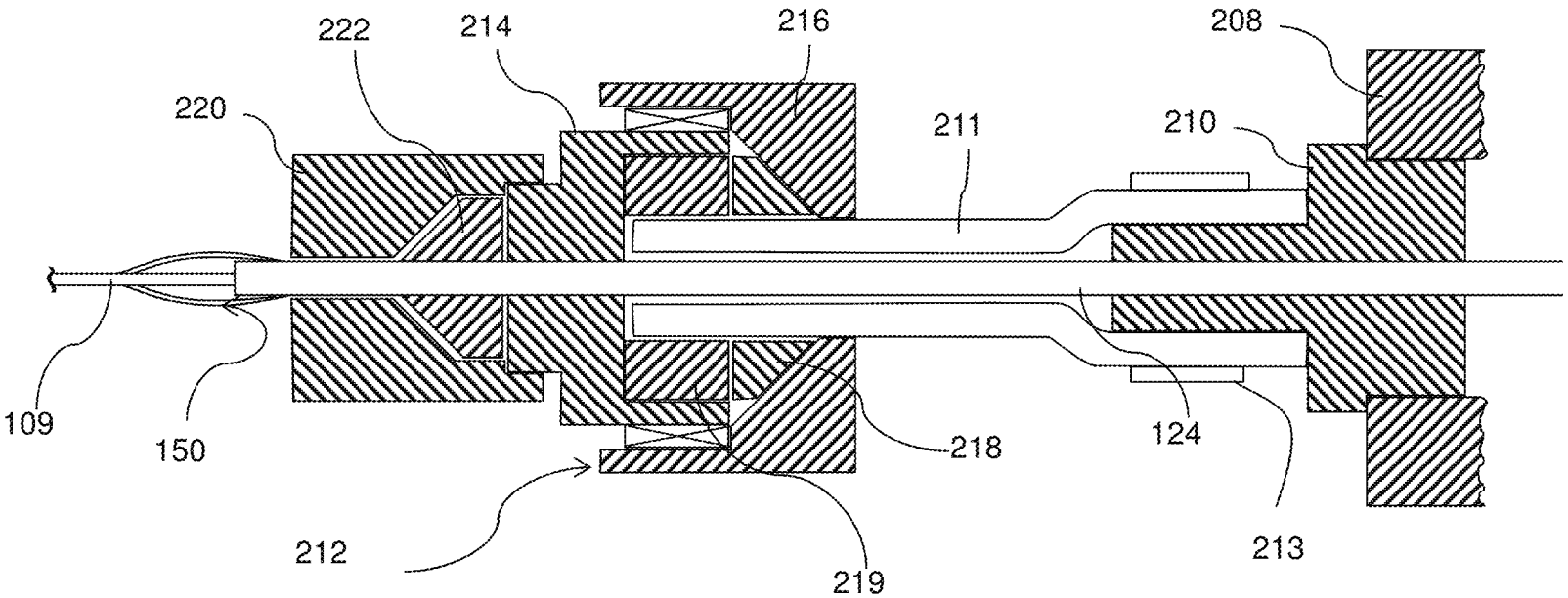
FIG. 24 is a section on the line XXIV-XXIV of FIG. 23.

The above examples illustrate the heating apparatus being used on sewer pipes where the internal pressures are minimal. However, the heating apparatus may be used with advantage in other environments, such as a pressurized water main or the drain line of a sump of a forced flow sewage system as shown in FIG. 20. Both of these applications require fittings rated to withstand a pressurized water system. In the embodiment of FIG. 20, a sump 200 is used to collect effluent and a pump 202 is activated to discharge the effluent through a waste pipe 204 to the leach field. A Tee piece 206 is provided between the vertical lift and horizontal run of the waste pipe 204 and is used to connect the heating apparatus 100. The heating apparatus 100 includes a protective pipe 124 encasing the heating element as described above. The pipe 124 is sized to fit within the waste pipe without unduly impeding the flow of water.

The heating apparatus 100 is secured to the Tee 206 by a step down bushing 208. A threaded coupling in the form of a stainless steel nipple 210 is threaded in to the bushing 208 and is connected by a support pipe 211 to a strain relief assembly 212. The support pipe 211 is secured on the coupling 210 by a crimped spirally wound stainless steel band 213 to provide a fluid tight seal.

The strain relief assembly 212 has a central housing 214, and a nut 216 that are threaded to one another. A conical clamping ring 218 is located between the housing 214 and nut 216 and bears against a stop collar 219 to grip the outer surface of the support pipe 211 as the housing is tightened. A second nut 220 is threaded on to the opposite side of the housing 214 and similarly has a conical clamping ring 222 to grip the outer surface of the protective pipe 124 and provide a seal around the protective pipe 124. The clamping ring 222 thus acts as a retainer that is received in the nut 220 and separates the interior and exterior of the water system.

Figure 25:
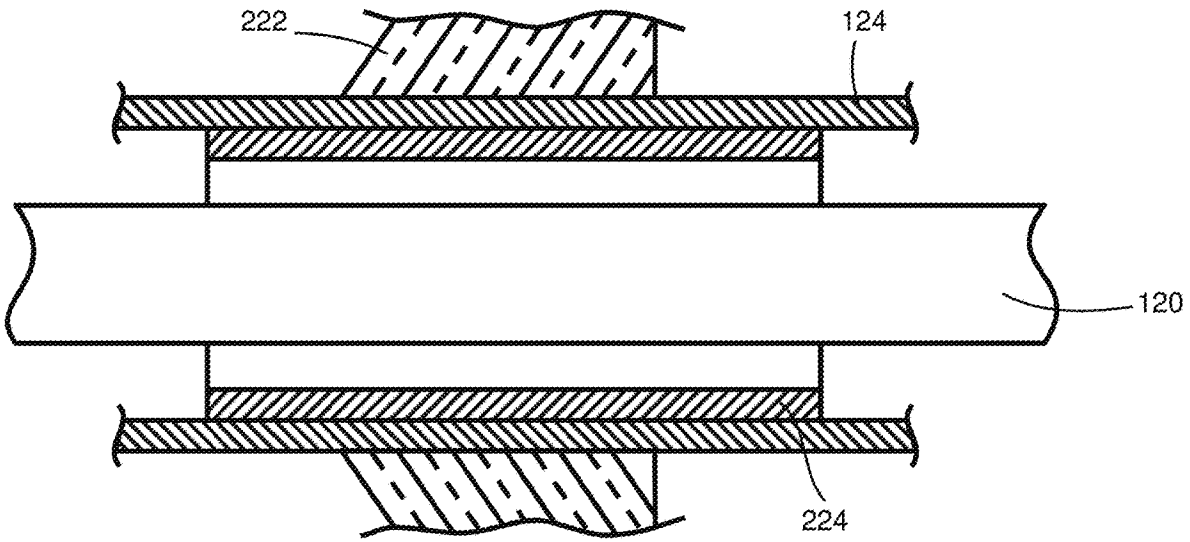
FIG. 25 is an enlarged view of a portion of the coupling assembly of FIG. 24.

The radial forces imposed on the protective pipe 124 by the clamping ring 222 may be sufficient to cause deformation or collapse of the wall of the protective pipe 124. As shown in FIG. 25, the protective pipe 124 is reinforced internally by a copper sleeve 224 that extends through the strain relief assembly 212. The sleeve 224 may be inserted after the heating element is fed in to the protective pipe 124 to ensure that it is not displaced or causes damage to the element 120.

The pipe 124 extends beyond the nut 220 and the electrical cord 109 is spliced to the heating element and covered with heat shrink sleeves as described above. The cord 109 is connected to the heating element within the protective pipe 124 so that the connection is protected by the housing and is not subject to tensile loads during operation. The heating element may be easily removed for service if necessary by releasing the heat shrink sleeve and withdrawing the heating element from the protective pipe, thereby allowing the sump pump to continue to function. Similarly, the protective pipe 1124 may be removed by releasing the nut 220 and withdrawing the protective pipe from the waste conduit.

To permit assembly and insertion of the heating apparatus, the strain relief assembly permits relative rotation of the support pipe 211 and the protective pipe 124. The nut 216 may be released to allow the pipe 211 to rotate relative to the housing 214 and the protective pipe 124 as the coupling 210 or bushing 208 is fed in to the Tee 206. The support pipe 211 rotates with the bushing 208 but the strain relief assembly 212 is maintained stationary so that the bushing 208 may be tightened or removed without rotating the protective pipe 124.

Figure 26:
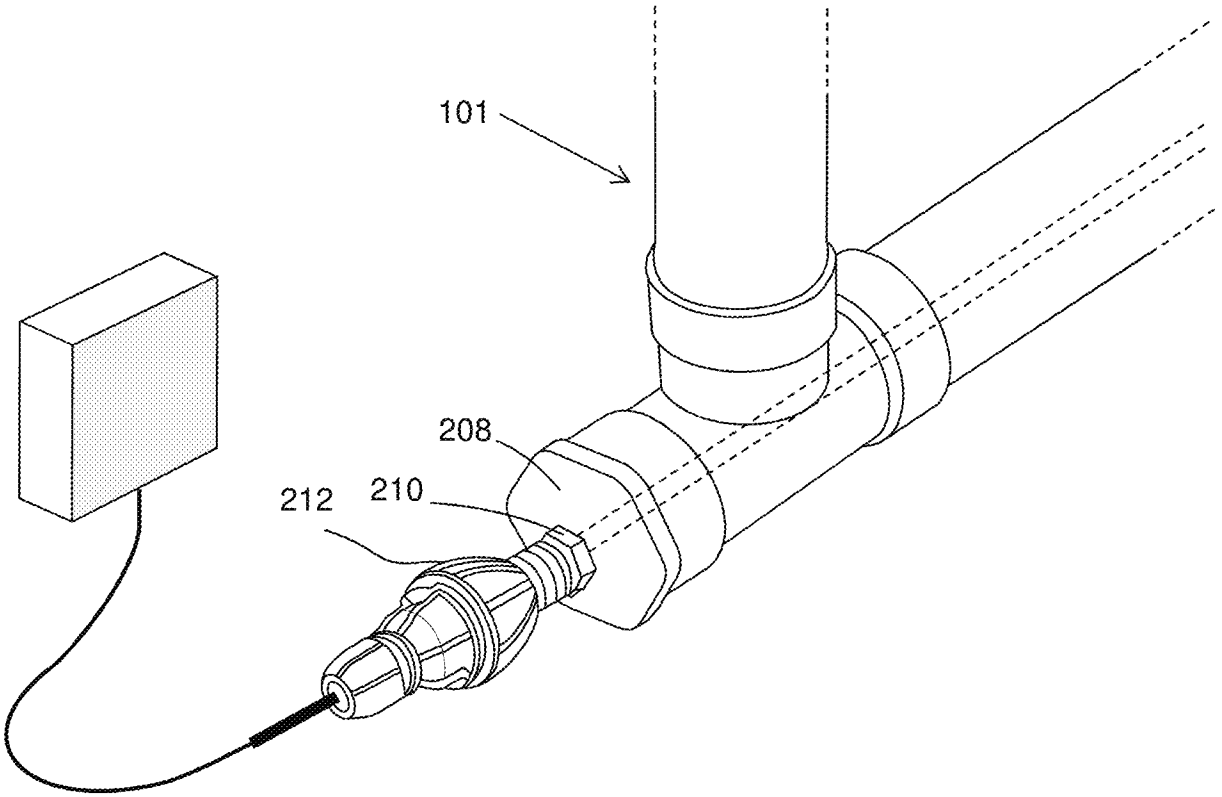
FIG. 26 is a view similar to FIG. 20 of an alternative application.

As noted above, the heating assembly may also be used in pressurized water mains as the protective pipe 124 is formed from a material acceptable for potable water. The installation of the heating assembly is illustrated in FIG. 26, from which it will be seen that the coupling 210 is secured by a bushing 208 connected to a Tee in the water main 101. Again, the heating element is secured by the strain relief assembly 212 as described above and permits the heating element 120 or the protective pipe 124 to be removed as required.

Accordingly, the systems and methods described herein provide a heating assembly including a heating apparatus that is configured to be received and located on a cleanout plug and within a pipe (e.g. sewer pipe and/or waste drain applications) for providing heat thereto and preventing freezing of the contents within the pipe. The heating element is segregated from the fluid in the pipe, thereby ensuring compliance with the applicable codes, and the element may be easily removed for replacement if necessary without interfering with the operation of the waste water or other fluid transfer systems.

It will be appreciated that the particular embodiments shown in the figures and described above are for illustrative purposes only and many other variations can be used according to the principles described. Although the above has been described with reference to certain specific embodiments, various modifications thereof will be apparent to those skilled in the art as outlined in the appended claims.

The invention claimed is:

1. A heating assembly for insertion in to a conduit of a water system consisting of a heating element, a protective pipe encasing at least part of said heating element, said protective pipe closed at one end and attached at the opposite end to a retainer dimensioned to be connected to a fitting of a water system, said protective pipe defining a chamber to contain said heating element and separate said heating element from said conduit, a bore extending through said retainer to receive slidably said protective pipe and permit longitudinal adjustment of said protective pipe relative to said retainer and thereby vary the length of protective pipe inserted in to said conduit, and a compressive clamp applying a radial force between said retainer and said protective pipe to cause said retainer to engage said protective pipe and inhibit relative movement between said protective pipe and said retainer and seal said protective pipe to said fitting, said heating element passing through said bore so as to be removable from within the protective pipe whilst maintaining the integrity of said conduit.

2. The heating assembly of claim 1 wherein said heating element is connected to a power supply adjacent to the opposite end of the protective pipe to said one end and the connection protected by a seal assembly.

3. The heating assembly of claim 2 wherein said seal assembly includes a first seal to cover said connection between said power supply and said heating element and a second seal between said power supply and said protective pipe.

4. The heating assembly of claim 3 wherein said protective pipe extends in said bore from one side of said retainer to the other.

5. The heating assembly of claim 4 wherein said first seal is located within said protective pipe.

6. The heating assembly of claim 5 wherein said second seal is located on the opposite side of said cap to said one end of said protective pipe.

7. The heating assembly of claim 6 wherein each of said seals includes a heat shrinkable sleeve.

8. The heating assembly of claim 1 wherein said protective pipe is flexible.

9. The heating assembly of claim 8 wherein said protective pipe is a plastics material.

10. The heating assembly of claim 9 wherein said pipe is formed from a high density polyethylene.

11. The heating assembly of claim 10 wherein said one end has a plug welded to said pipe to seal said one end.

12. The heating assembly of claim 8 wherein said one end of said protective pipe is tapered.

13. The heating assembly of claim 1 wherein said heating element is flaccid and is a close fit within said protective pipe to be supported by said protective pipe.

14. The heating assembly of claim 13 wherein said heating element is a self-regulating heating cable.

15. The heating assembly of claim 1 wherein said retainer is a push fit in said fitting to permit said heater assembly to be inserted in said water system without rotation.

16. The heating assembly of claim 15 wherein said retainer is adapted to be mechanically secured to said fitting and selectively releasable therefrom.

17. The heating assembly of claim 1 wherein said retainer is releasably secured to said fitting to permit relative rotation between said fitting and said retainer.

18. The heating assembly of claim 17 wherein said retainer is incorporated in to a strain relief assembly.

19. The heating assembly of claim 1 wherein said protective pipe is locally reinforced in the vicinity of said retainer.

20. The heating assembly of claim 19 wherein a sleeve is inserted within said protective pipe to resist radial loads applied to said pipe.

* * * * *